US008641225B2

(12) United States Patent
Yeh

(10) Patent No.: US 8,641,225 B2
(45) Date of Patent: Feb. 4, 2014

(54) FLASHLIGHT ZOOMING STRUCTURE

(75) Inventor: Hsueh-Chu Yeh, Tainan (TW)

(73) Assignee: Shih-Hao Wang, Tainan (TW)

( * ) Notice: Subject to any disclaimer, the term of this patent is extended or adjusted under 35 U.S.C. 154(b) by 255 days.

(21) Appl. No.: 13/326,444

(22) Filed: Dec. 15, 2011

(65) Prior Publication Data

US 2013/0155667 A1 Jun. 20, 2013

(51) Int. Cl.
*F21L 4/00* (2006.01)

(52) U.S. Cl.
USPC ..... 362/187; 362/202

(58) Field of Classification Search
USPC ..... 362/187–188, 202–206
See application file for complete search history.

(56) References Cited

U.S. PATENT DOCUMENTS 8,444,290 B2 * 5/2013 Opolka ..... 362/202

* cited by examiner

*Primary Examiner* — Jason Moon Han
(74) *Attorney, Agent, or Firm* — Alan Kamrath; Kamrath IP Lawfirm, P.A.

(57) ABSTRACT

A flashlight zooming structure includes a main body and a zooming assembly screwed on one end of a neck of the main body and configured as follows. A transparent lamp cup is received in a cup seat. The cup seat has outwardly extending lugs respectively received in channels formed on the inner periphery of the cap. A ring has oblique notches respectively connected with the lugs of the cup seat. A middle annular element has projections respectively fitted in recesses of the ring and has hooks respectively engaged with engaging grooves of the cap. To illuminate a distant or nearby target, the zooming assembly is rotated in the desired direction so that the light emitted by a lighting unit at one end of the neck of the main body is projected outward through the transparent lamp cup as a convergent or divergent light beam.

2 Claims, 7 Drawing Sheets

FLASHLIGHT ZOOMING STRUCTURE

BACKGROUND OF THE INVENTION

1. Technical Field

The present invention relates to a flashlight zooming structure. More particularly, the present invention relates to a flashlight zooming structure whereby a flashlight can project light to a distant or nearby target through adjustment of a zooming assembly provided at one end of a neck of the flashlight main body. By rotating the zooming assembly in the desired direction, the light emitted by a lighting unit at the end of the neck of the main body is projected outward through a transparent lamp cup in the zooming assembly as a convergent light beam that can be focused on a small area in the distance or as a divergent light beam that spreads out at a wide angle.

2. Description of Related Art

A flashlight for illumination purposes typically includes a main body for receiving a battery pack and conductive components, a lighting unit provided at one end of a neck of the main body, and a cap screwed on the neck of the main body. To use the flashlight, a power switch provided on a lateral side or at one end of the main body is turned on, thereby driving the lighting unit to emit light for illuminating a target.

However, the lighting unit in such a flashlight usually has a single fixed focus, and in most cases the light emitted by the lighting unit can only be shed on a nearby target divergently. As the divergent light cannot reach a greater distance, the flashlight cannot be used to illuminate a distant target.

BRIEF SUMMARY OF THE INVENTION

The present invention provides an improvement over the existing flashlights, particularly in terms of the capability to illuminate targets at different distances. It is desirable that a flashlight can project light to a faraway or nearby target through adjustment of a zooming assembly provided at one end of a neck of the flashlight main body, and that by manually rotating a cap in the zooming assembly, a transparent lamp cup received in a cup seat is moved forward or backward to increase or decrease the distance between the lamp cup and a lighting unit at the end of the neck of the flashlight main body, thus allowing the light emitted by the lighting unit to project outward through the lamp cup as a convergent light beam that can be focused on a small area in the distance or as a divergent light beam that spreads out at a wide angle. In short, it is desirable that a flashlight can be flexibly adjusted to project light to different distances.

The primary object of the present invention is to provide a flashlight which includes a main body and a zooming assembly. The zooming assembly is threadedly connected to one end of a neck of the main body and includes a cap, a cup seat, a lamp cup, a middle annular element, and a ring. The cap has an inner open end provided with spaced engaging grooves and has an inner periphery symmetrically provided with channels. The cup seat has a downwardly tapering inner periphery that defines a relatively large open end and a relatively small open end. The relatively large open end of the cup seat has an outer periphery provided with at least two lugs respectively received in the channels of the cap. Also, the relatively large open end of the cup seat is peripherally provided with a plurality of inwardly extending fasteners. The lamp cup is transparent and is centrally formed with a convex lens. The lamp cup is received in the cup seat and is limited in position by the fasteners of the cup seat. The middle annular element has one end extended with a connecting portion, wherein the connecting portion is peripherally provided with a plurality of outwardly extending hooks respectively engaged with the engaging grooves of the cap and is peripherally provided with a plurality of projections respectively fitted in recesses of the ring such that the ring and the middle annular element are limited in position with respect to each other. The ring has one end peripherally provided with at least two oblique notches respectively connected with the lugs at one end of the cup seat, wherein the lugs are respectively movable in the oblique notches. The middle annular element has an inner periphery formed with threads threadedly connected with an externally threaded portion of the neck of the main body. To operate the zooming assembly mounted at one end of the flashlight, the cap is rotated in the desired direction so that the lugs on the outer periphery of the relatively large open end of the cup seat are respectively moved upward or downward along the oblique notches of the ring. In consequence, the lamp cup received in the cup seat is moved forward or backward with the cup seat, and the light emitted by a lighting unit at the end of the neck of the main body is projected outward through the transparent lamp cup in the zooming assembly as a convergent light beam that can be focused on a small area in the distance or as a divergent light beam that spreads out at a wide angle.

The second object of the present invention is to provide the foregoing flashlight, wherein the convex lens of the transparent lamp cup is convex outward, and the lamp cup further has a lower end provided with a concave region. The light emitted by the lighting unit at the end of the neck of the main body is guided by the concave region and projected outward through the convex lens so as to produce a convergent light beam that can be focused on a small area in the distance or a divergent light beam that spreads out at a wide angle.

BRIEF DESCRIPTION OF THE SEVERAL VIEWS OF THE DRAWINGS

The structure as well as a preferred mode of use, further objects, and advantages of the present invention will be best understood by referring to the following detailed description of an illustrative embodiment in conjunction with the accompanying drawings, in which.

DETAILED DESCRIPTION OF THE INVENTION

Figure 1:
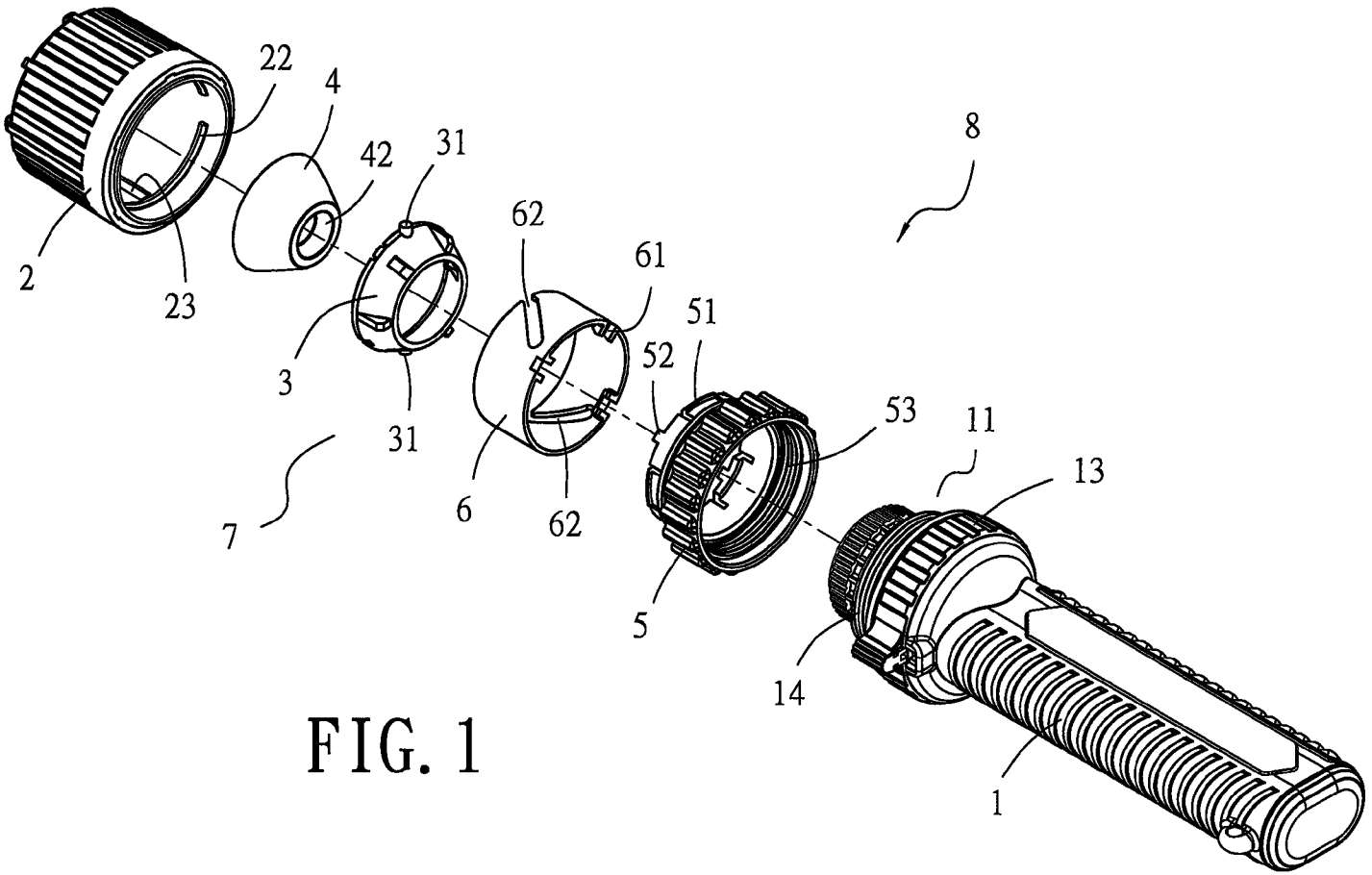
FIG. 1 is an exploded perspective view of a flashlight according to an embodiment of the present invention.

Please refer to FIG. 1 for a flashlight zooming structure according to an embodiment of the present invention. As shown in the drawing, a flashlight 8 includes a main body 1 and a zooming assembly 7. The zooming assembly 7 is threadedly connected to one end of the neck 11 of the main body 1 and includes a cap 2, a cup seat 3, a lamp cup 4, a middle annular element 5, and a ring 6.

Figure 5:
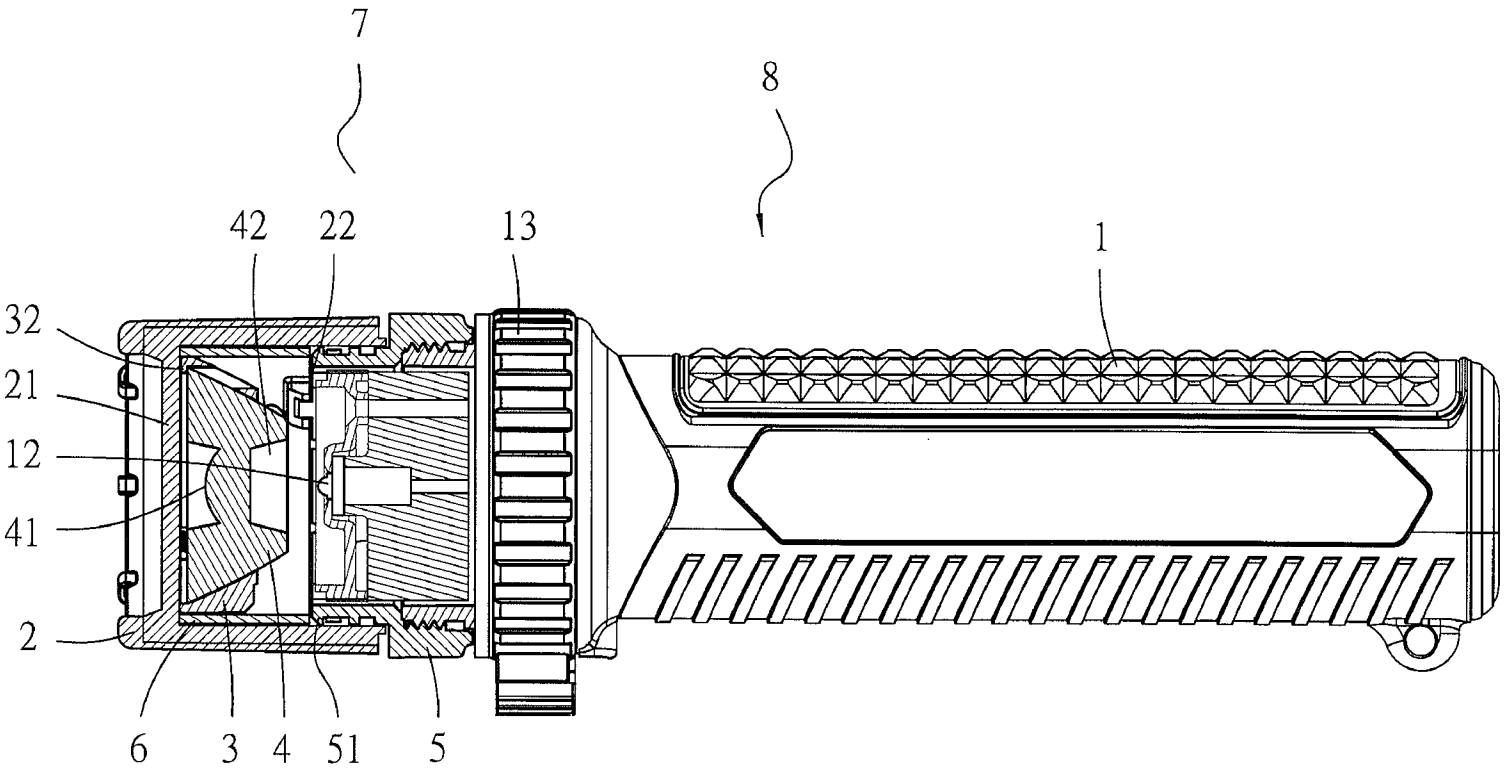
FIG. 5 is a partially sectional view showing how the zooming assembly of the flashlight depicted in FIG. 1 is adjusted to provide a convergent light beam that can be focused on a small area in the distance.

The main body 1 is a flashlight main body in which a battery pack and conductive components are received. The upper end of the main body 1 is defined as the neck 11, and the upper end of the neck 11 is connected with a lighting unit 12 (implemented herein by a light-emitting diode, as can be seen in FIG. 5). A lower annular element 13 is mounted around a lower section of the neck 11 of the main body 1 so that, by rotating the lower annular element 13, a power switch connected thereto is driven to switch between different lighting modes, such as a turned on mode, a flashing mode, and a turned off mode. (The power switch is not a major technical feature of the present invention and therefore will not be dealt with in further detail herein.) In addition, the upper end of the neck 11 of the main body 1 has an externally threaded portion 14.

The cap 2 is a component connected with a transparent cover 21 (see FIG. 5) at one end. The inner open end of the cap 2 is provided with spaced engaging grooves 22 (see FIG. 1). The inner periphery of the cap 2 is symmetrically provided with channels 23.

The cup seat 3 is a movable component shaped according to the interior space of the cap 2. As shown more clearly in FIG. 5, the inner periphery of the cup seat 3 tapers downward and thus defines a relatively large open end and a relatively small open end. The relatively large open end of the cup seat 3 has an outer periphery provided with at least two lugs 31. Also, the relatively large open end of the cup seat 3 is peripherally provided with a plurality of inwardly extending fasteners 32.

The lamp cup 4 is a transparent component shaped according to the inner periphery of the cup seat 3. As shown in FIGS. 1 and 5, the lamp cup 4 is centrally formed with a convex lens 41 which is convex toward the outside, and the lower end of lamp cup 4 is formed with a concave region 42.

The middle annular element 5 is a connecting component shaped according to the main body 1 and the cap 2. A connecting portion extends from one end of the middle annular element 5 and is peripherally formed with a plurality of outwardly extending hooks 51 and a plurality of projections 52. The inner periphery of the middle annular element 5 is provided with threads 53.

The ring 6 is a guiding component shaped according to the cup seat 3 and the middle annular element 5. One end of the ring 6 is peripherally provided with a plurality of recesses 61, and the other end of the ring 6 is peripherally provided with at least two oblique notches 62.

Figure 2:
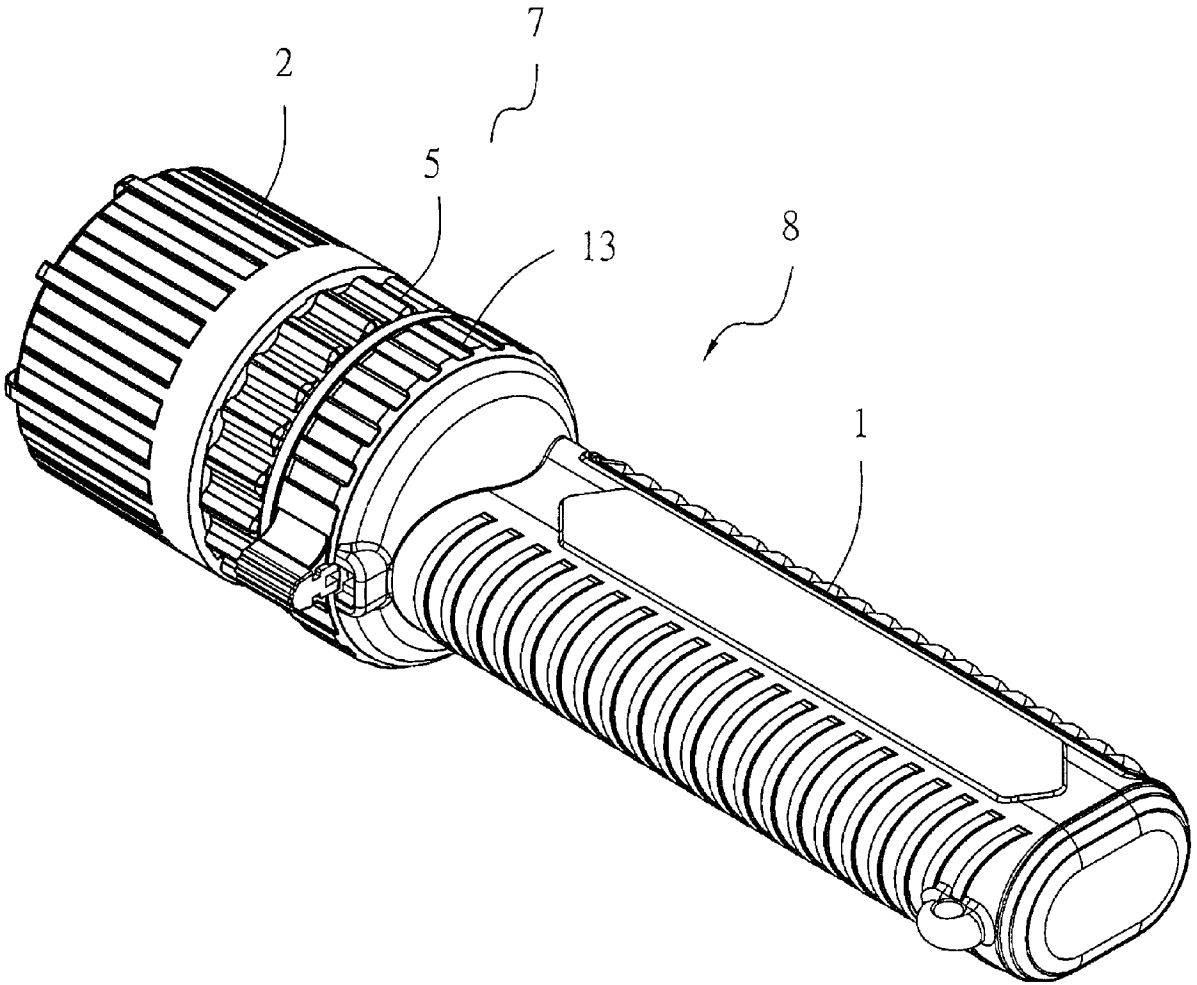
FIG. 2 is an assembled perspective view of the flashlight depicted in FIG. 1.
Figure 3:
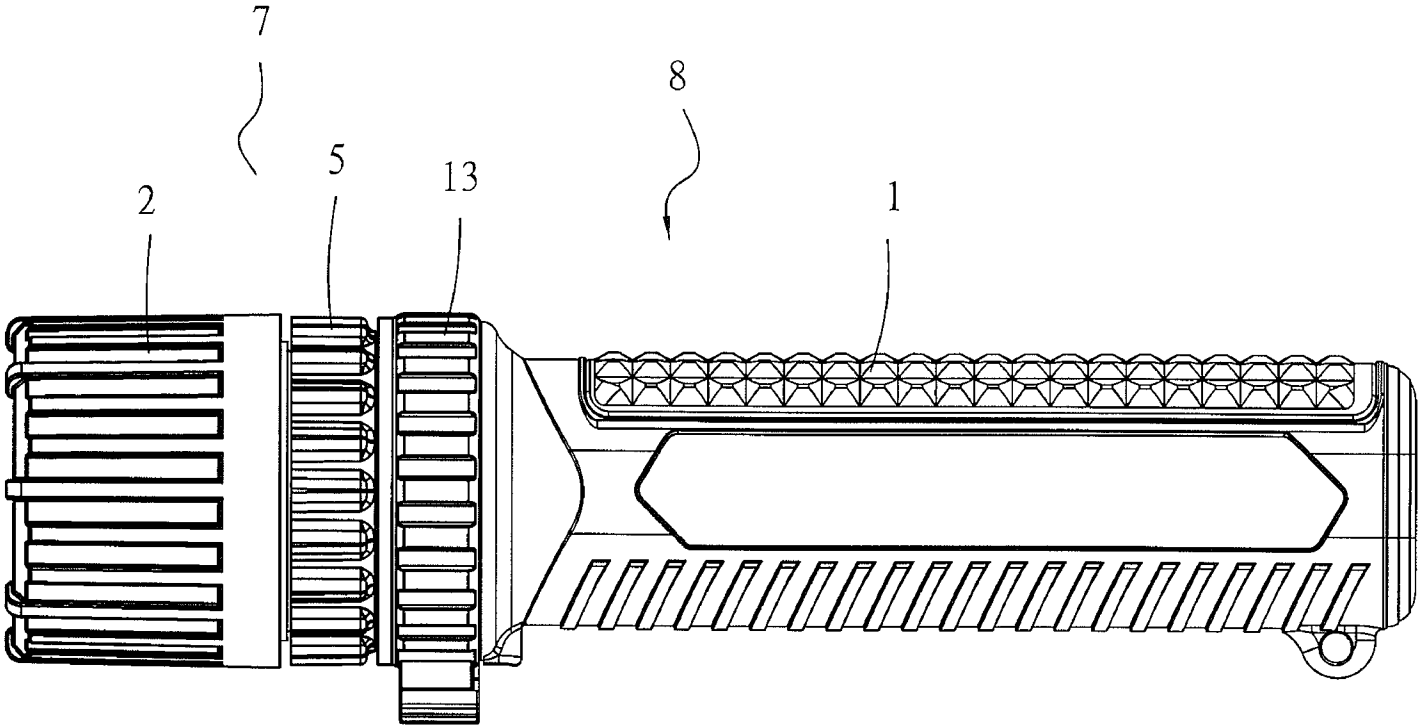
FIG. 3 is a top view of the flashlight depicted in FIG. 1.
Figure 4:
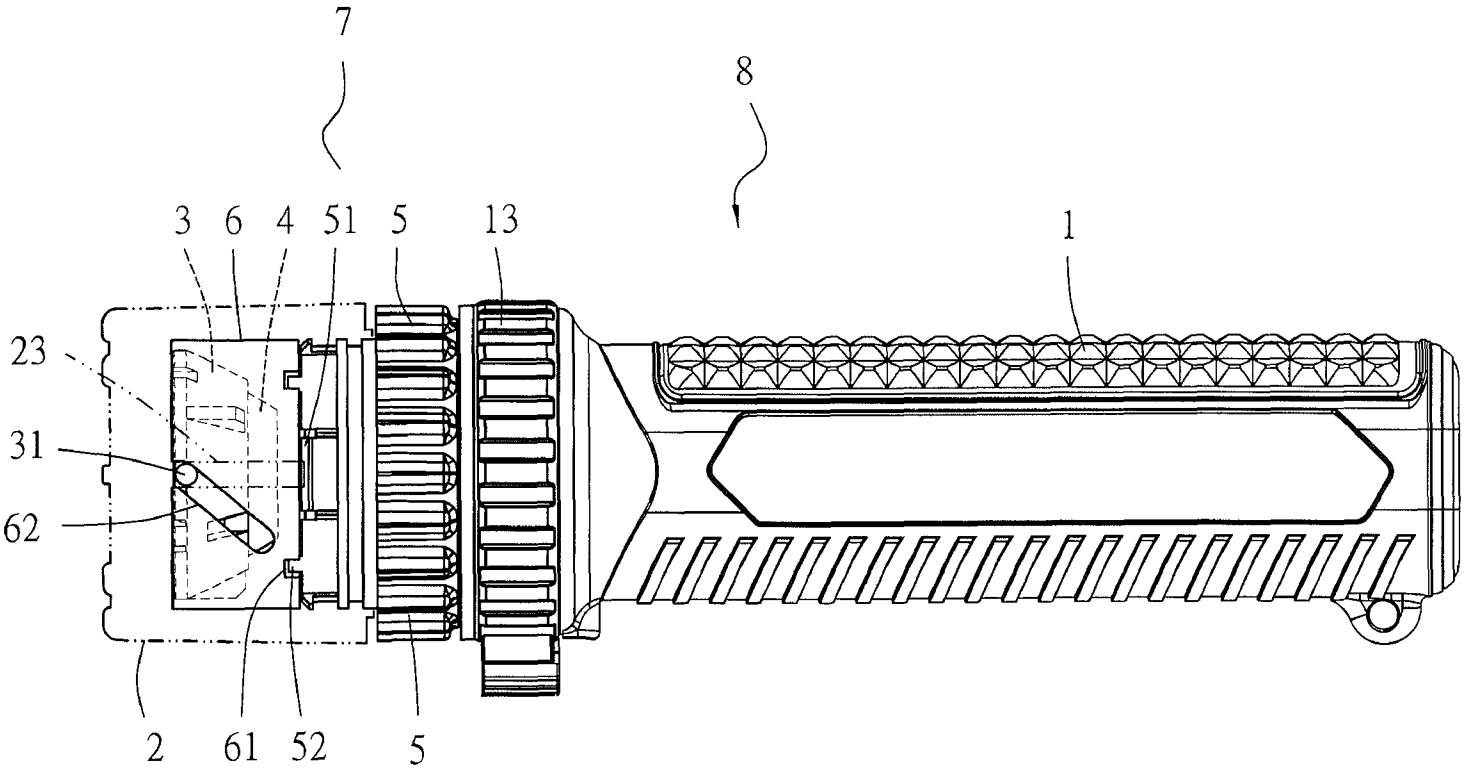
FIG. 4 shows how a zooming assembly of the flashlight depicted in FIG. 1 is adjusted to provide a convergent light beam that can be focused on a small area in the distance.

The cap 2, the cup seat 3, the lamp cup 4, the middle annular element 5, and the ring 6 are put together as follows. Referring to FIGS. 1 and 5, the first step is to place the transparent lamp cup 4, which is centrally formed with the convex lens 41, into the cup seat 3 such that the lamp cup 4 is limited in position by the fasteners 32 provided along the periphery of one end of the cup seat 3. In the second step, the lugs 31 on the outer periphery of the relatively large open end of the cup seat 3, which now receives the transparent lamp cup 4, are inserted into the corresponding channels 23 of the cap 2 respectively, as shown in FIG. 4. In the third step, the peripheral oblique notches 62 at one end of the ring 6 are respectively connected with the lugs 31 at one end of the cup seat 3, which is now received in the cap 2, and then the peripheral projections 52 at one end of the middle annular element 5 are inserted into the recesses 61 of the ring 6 respectively such that the middle annular element 5 and the ring 6 are limited in position relative to each other. At the same time, the hooks 51 extending outward from the periphery of the middle annular element 5 are respectively engaged with the engaging grooves 22 of the cap 2, as shown in FIG. 5. Thus, the zooming assembly 7 is completely formed. In the fourth and last step, the threads 53 on the inner periphery of the middle annular element 5 in the zooming assembly 7 are threadedly connected with the externally threaded portion 14 of the neck 11 of the main body 1 to form the flashlight 8, as shown in FIGS. 2 and 3.

Figure 6:
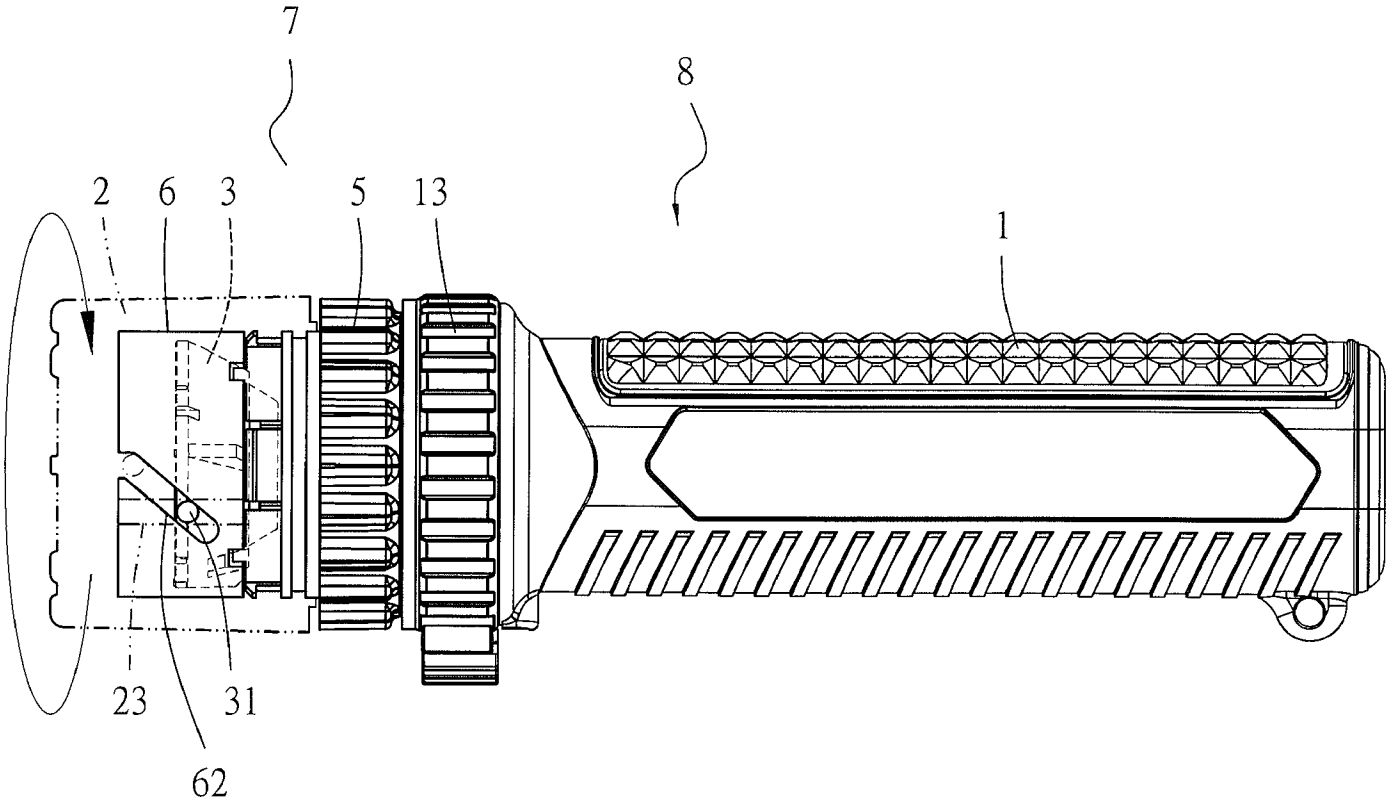
FIG. 6 shows how the zooming assembly of the flashlight depicted in FIG. 1 is adjusted to provide a divergent light beam that spreads out at a wide angle.
Figure 7:
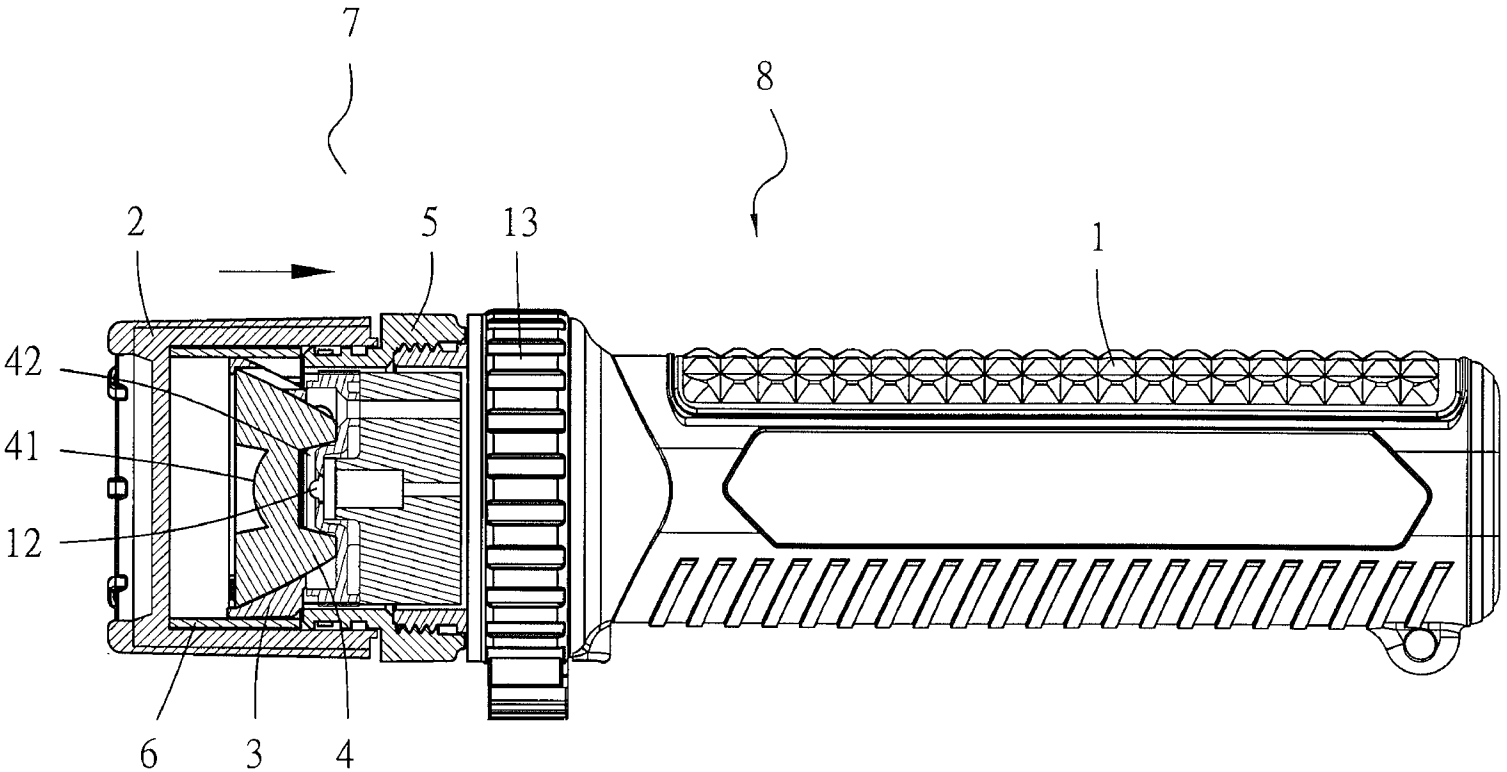
FIG. 7 is a partially sectional view showing how the zooming assembly of the flashlight depicted in FIG. 1 is adjusted to provide a divergent light beam that spreads out at a wide angle.

The zooming assembly 7 mounted at one end of the neck 11 of the main body 1 of the flashlight 8 is operated in the following manner. The cap 2 is rotated in the desired direction (e.g., in a reverse direction if it is desired to converge or diverge light, as shown in FIGS. 4 and 5; or in a forward direction for zooming in short-distance lighting, as shown in FIGS. 6 and 7) so that the peripheral lugs 31 of the cup seat 3 in the cap 2 are moved upward or downward along the oblique notches 62 of the ring 6 respectively. As a result, the lamp cup 4 received in the cup seat 3 moves forward or backward with the cup seat 3, and the light emitted by the lighting unit 12 at one end of the neck 11 of the main body 1 is guided by the concave region 42 at one end of the transparent lamp cup 4 and is projected outward through the convex lens 41 so as to produce a convergent light beam that can be focused on a small area in the distance or a convergent light beam that spreads out at a wide angle.

When it is desired to remove the zooming assembly 7 threadedly connected to one end of the neck 11 of the main body 1 of the flashlight 8, the user only has to rotate the middle annular element 5, and the zooming assembly 7 can be rapidly detached from the neck 11 of the main body 1.

Furthermore, by rotating the lower annular element 13, the flashlight 8 can be switched between predetermined lighting modes, such as a strong light mode, a weak light mode, a flashing mode, and a turned off mode.

What is claimed is:

1. A flashlight zooming structure, comprising a main body and a zooming assembly threadedly connected to an end of a neck of the main body, the flashlight zooming structure being characterized in that:

the zooming assembly comprises a cap, a cup seat, a lamp cup, a middle annular element, and a ring, the cap having an inner open end formed with spaced engaging grooves, the cap having an inner periphery symmetrically provided with channels, the cup seat having a downwardly tapering inner periphery defining a relatively large open end and a relatively small open end, the relatively large open end of the cup seat having an outer periphery provided with at least two lugs respectively inserted in the channels of the cap, the relatively large open end of the cup seat being peripherally provided with a plurality of inwardly extending fasteners, the lamp cup being transparent and centrally formed with a convex lens, the lamp cup being received in the cup seat and limited in position by the fasteners of the cup seat, the middle annular element having an end extended with a connecting portion, the connecting portion being peripherally provided with a plurality of outwardly extending hooks respectively engaged with the engaging grooves of the cap and a plurality of projections respectively inserted in recesses of the ring such that the ring and the middle annular element are limited in position relative to each other, the ring having an end peripherally provided with at least two oblique notches, the oblique notches being respectively connected with the lugs at the relatively large open end of the cup seat in the cap such that the lugs are respectively movable in the oblique notches, the middle annular element having an inner periphery provided with threads threadedly connected with an externally threaded portion of the neck of the main body;

wherein the zooming assembly is operated by rotating the cap in a desired direction so that the lugs provided on the outer periphery of the relatively large open end of the cup seat in the cap are moved upward or downward along the oblique notches of the ring respectively and the lamp cup received in the cup seat is moved along with the cup seat, thus allowing light emitted by a lighting unit at the end of the neck of the main body to project outward through the transparent lamp cup in the zooming assembly as a convergent or divergent light beam.

2. The flashlight zooming structure of claim 1, wherein the convex lens of the transparent lamp cup is outwardly convex, and the lamp cup has a lower end provided with a concave region, so as for the light emitted by the lighting unit at the end of the neck of the main body to be guided by the concave region and projected outward through the convex lens as the convergent or divergent light beam.

* * * * *